United States Patent [19]

Toney

[11] Patent Number: 4,864,909

[45] Date of Patent: Sep. 12, 1989

[54] STRINGED INSTRUMENT AND TREMOLO APPARATUS

[76] Inventor: William L. Toney, 502 Austin, Borger, Tex. 79008

[21] Appl. No.: 275,284

[22] Filed: Nov. 23, 1988

[51] Int. Cl.[4] ..... G10D 3/04

[52] U.S. Cl. ..... 84/313

[58] Field of Search ..... 84/313

[56] References Cited

U.S. PATENT DOCUMENTS

| | | | |
|---|---|---|---|
| 1,750,325 | 3/1930 | Mills | 84/313 X |
| 1,839,395 | 1/1932 | Kauffman | 84/313 |
| 2,893,282 | 7/1959 | Searles | 84/313 |
| 2,897,711 | 8/1959 | Matthew et al. | 84/313 |
| 2,972,923 | 2/1961 | Fender | 84/313 |
| 3,407,697 | 10/1968 | Jackson | 84/313 X |
| 4,141,271 | 2/1979 | Mullen | 84/313 X |
| 4,453,443 | 6/1984 | Smith | 84/313 X |
| 4,555,970 | 12/1985 | Rose | 84/313 |

*Primary Examiner*—Lawrence R. Franklin
*Attorney, Agent, or Firm*—Guy McClung

[57] ABSTRACT

A stringed instrument which in one embodiment has a sounding board or box to which stretched strings are attached and which has a tremolo apparatus with a lever arm extending from a housing, the lever arm connected to one or more strings of the instrument, the lever arm movably secured to a shaft movably mounted in an interior opening in a wall in the housing, the shaft biased by a spring or springs and having stop means thereon so that, upon either extension or compression of the spring or springs when the lever arm is moved, the shaft returns to substantially the same position it maintained prior to spring movement so that the pre-tremolo tension and pitch of the string or strings attached to the lever arm is substantially the same post-tremolo. A tremolo apparatus as described above.

6 Claims, 2 Drawing Sheets

FIG. 1
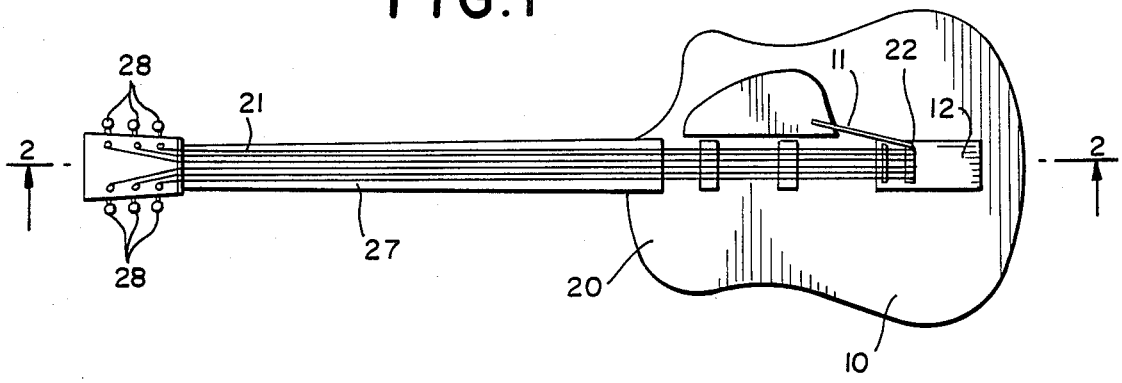
FIG. 2
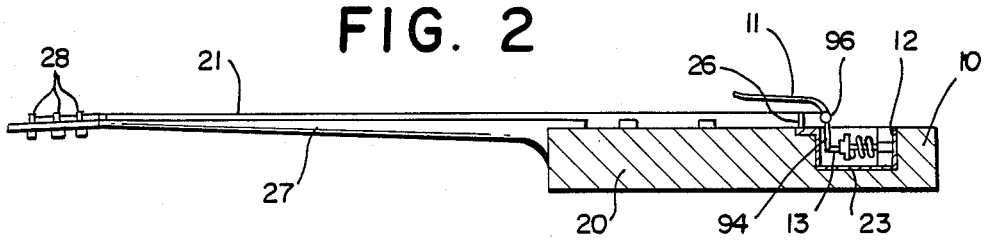
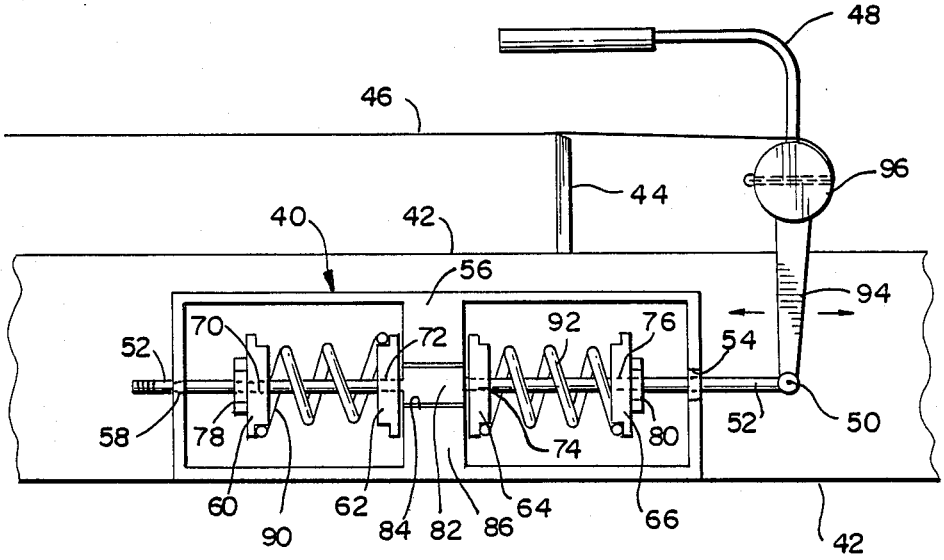
FIG. 6

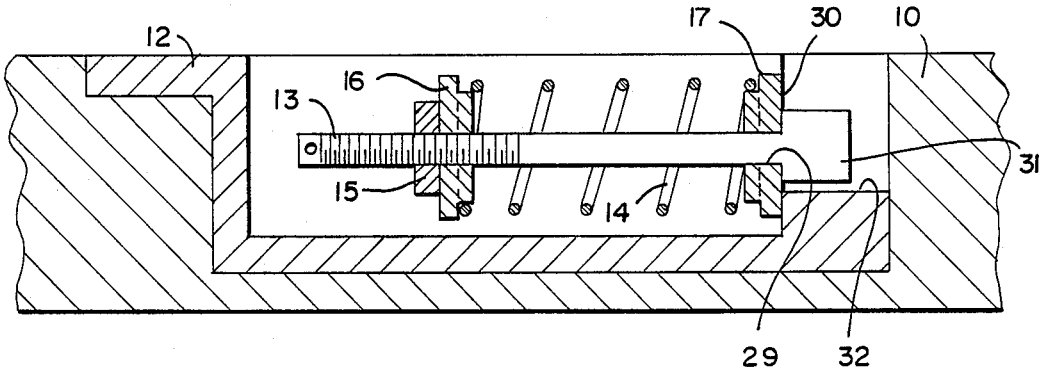
FIG. 3
FIG. 4
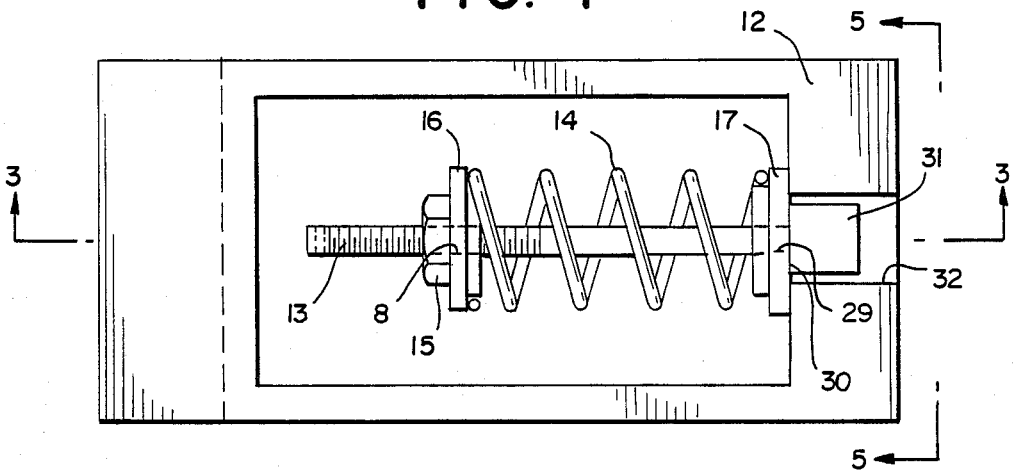
FIG. 5
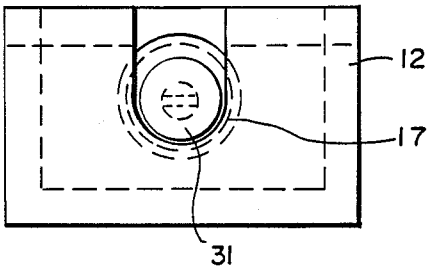

STRINGED INSTRUMENT AND TREMOLO APPARATUS

BACKGROUND OF THE INVENTION

1. Field of the Invention

This invention is directed to tremolo apparatuses for string musical instruments, to instruments with such devices, and, particularly, to such devices for guitars.

2. Description of the Prior Art

Well-known conventional tremolo devices alter the tension on the strings of string musical instruments and dynamically alter pitch, producing unusual and often pleasant tone variations.

There are many tremolo devices of many different configurations known to those skilled in the musical instrument arts. Many tremolo devices have the disadvantage that use of the tremolo device or even merely playing the instruments with a tremolo device will alter the pitch of said instrument.

U.S. Pat. No. 4,171,661 describes a technique for fixing the pitch of the instrument by clamping the strings at the bridge and the nut at the end of the neck. These clamps produce a large friction force between the guitar and the strings. This design requires a complex tuning procedure of loosing clamps at the nut, retuning, and reclamping.

Among the many tuning peg designs are included designs described in U.S. Pat. Nos. 554,057, and 2,557,877 which disclose means for attaching or clamping the string to the tuning peg shaft. Another tuning device which clamps the string is presented in U.S. Pat. No. 4,141,271, which undesirably requires tools to operate because the spacing between tuning members is very small. Tremolo bridge designs include that shown in U.S. Pat. No. 2,741,146 in which the bridge permits the instrument to go out of tune. A pivoting means prohibits the bridge from returning to its exact original location; the bridge has saddles which move and alter the pitch of the instrument; and the saddles present a significant friction force on the string which also can alter pitch.

There has long been a need for a tremolo which will return to an original position so that strings affected by the tremolo will not be de-tuned and will return to a correct pitch after use of the tremolo. There has long been a need for an apparatus which makes it possible to effectively use a spring or springs in a tremolo device. There has long been a need for a tremolo utilizing a spring which has means for positively stopping spring movement upon return of a tremolo activating lever or arm so that the string position prior to the use of the tremolo is regained. There have long been needs for instruments with such tremolos. These and other needs are recognized, addressed, and satisfied by the present invention.

SUMMARY OF THE INVENTION

The present invention, in one embodiment, is a stringed instrument with a sounding board or box to which stretched strings are attached and which has a tremolo apparatus with a lever arm extending from a housing, the lever arm connected to one or more strings of the instrument, the lever arm movably secured to a shaft movably mounted in an interior opening in a wall in the housing, the shaft biased by a spring or springs and having stop means thereon so that, upon either extension or compression of the spring or springs when the lever arm is moved, the shaft returns to substantially the same position it maintained prior to spring movement so that the pre-tremolo tension and pitch of the string or strings attached to the lever arm is substantially the same post-tremolo. The present invention also teaches a tremolo apparatus as described above.

In one embodiment of a tremolo apparatus according to this invention one spring is used. In another embodiment two springs can be used. Although one preferred embodiment of a tremolo apparatus according to this invention is a tremolo apparatus for a guitar; and although one preferred embodiment of a musical instrument according to this invention is a guitar with a unique new tremolo apparatus; it is to be understood that the present invention includes within its scope any stringed instrument without limitation and tremolo apparatuses for such instruments.

It is, therefore, an object of this invention to provide a new, unique, useful, and nonobvious tremolo apparatus for stringed musical instruments.

Another object of this invention is the provision of stringed musical instruments with such a tremolo apparatus, including but not limited to, guitars.

Further objects of this invention are the provision of a tremolo apparatus which will insure that the use of the tremolo apparatus does not substantially alter the tension of strings connected to the tremolo apparatus, and the provision of instruments with such a tremolo apparatus.

Additional objects of this invention are the provision of a tremolo apparatus having springs that are returned substantially to a pre-tremolo position after tremolo use, and the provision of instruments with such a tremolo apparatus.

The present invention, therefore, recognizes, addresses, and satisfies the long-felt needs for an effective tremolo apparatus and instruments with such an apparatus.

These and other objects of this invention will be clear to one of skill in this art who has the benefit of this invention's teachings which include the drawings and the following description of presently-preferred embodiments of the invention which are given for the purpose of disclosure in accord with the patent laws of the United States. Although these descriptions are detailed to insure adequacy and aid understanding, this is not intended to prejudice that purpose of a patent which is to claim an invention no matter how others may later disguise it by variations in form or additions or further improvements. The claims at the end of this specification are intended as an aid toward this purpose.

DESCRIPTION OF THE DRAWINGS

So that the manner in which the above-recited features, advantages, and objects of the invention, as well as other which will become apparent, are attained and can be understood in detail, a more particular description of the invention briefly summarized above may be had by reference to the embodiments thereof which are illustrated in the appended drawings, which drawings form a part of this specification. It is to be noted, however, that the appended drawings illustrate only preferred embodiments of the invention and are therefore not to be considered limiting of its scope, for the invention may admit to other equally effective embodiments.

FIG. 1 is a top plan view of a guitar according to this invention with a tremolo apparatus.

FIG. 2 is a side cross-sectional side view along line 2—2 of the guitar of FIG. 1.

FIG. 3 is a side cross-sectional view along line 3—3 of FIG. 4 of the tremolo apparatus of FIG. 4.

FIG. 4 is a top view of the tremolo apparatus of FIG. 1.

FIG. 5 is an end view along line 5—5 of FIG. 4 of the tremolo apparatus of FIG. 4.

FIG. 6 is a side cross-sectional view of a tremolo apparatus according to this invention.

DESCRIPTION OF PRESENTLY-PREFERRED EMBODIMENTS

As shown in FIGS. 1, 2, 3–5, a guitar 10 according to this invention has a body 20 with a bridge 26 across which pass a plurality of strings 21 which extend over a neck 27 and are connected to the neck via pegs 28. A tremolo apparatus 22 according to this invention has a housing 12 which is disposed in a recess 23 in the body 20 of the guitar 10. The tremolo apparatus 22 has a movable shaft 13 to which is pivotably connected a tremolo arm 11 which extends above the body 12. The strings 21 are secured to the tremolo arm 11 so that movement of the arm alters the tension of the strings.

The shaft 13 as shown in FIGS. 3–5 is movably disposed through a hole 29 in the retainer 17. When the arm 11 (see FIGS. 1, 2) is depressed toward the guitar body (lessening string tension), the shaft 13 moves to the right in FIG. 3, compressing a spring 14 which is disposed about the shaft 13 and held in place by retainers 16 and 17 which are disposed about the shaft 13. The shaft 13 is movable within the retainer 17. A lobe 31 on the end of the shaft 13 is free to move in a recess 32 in the housing 12. The shaft 13 is movably disposed through a hole 8 in the retainer 16. When the arm 11 is released from a depressed position, the spring 14 extends, moving the shaft 13 back to the left until the lobe 31 contacts a wall 30 of the retainer 17, thereby returning the strings to substantially the same tension as that which they were under before the arm 11 was depressed.

If the arm 11 is pulled up and away from the body 20 of the guitar (increasing string tension), the shaft 13, retainers 16, 17 and the spring 14 move as a unit. The retainer 17 which is contacted by the lobe 31 is pulled away from the recess 32, i.e., slightly away from its end of the housing 12. A self-locking nut 15 can be used to adjust the tension of spring 14; e.g., to compensate for different types or gauges of strings. It is preferred, although not required, that the strength of the spring 14 be equal to about 110% of the string tension strength.

A tremolo device 40 as shown in FIG. 6 is disposed within an instrument body such as a guitar body 42. A bridge 44 extends upwardly from the body 42 and supports strings 46 which are connected to a neck end (not shown) and to a tremolo arm 48 which extends through the body 42 and is movably attached with a pin 50 to a movable shaft 52. The shaft 52 extends through a hole 54 with the interior of a housing 56 and, at its other end, out of a hole 58 in the housing 56. Four retainers 60, 62, 64, 66 are movably disposed about the shaft 52 so that the shaft 52 is movable in holes 70, 72, 74, 76 respectively in the retainers. A self-locking nut 78 abuts retainer 60 and prevents movement of retainer 60 further to the left past the nut 78; similarly, a self-locking nut 80 abuts retainer 66 and prevents movement of retainer 66 further to the right from the nut 80. A center lobe 82 is secured on the shaft 52 and is disposed in an opening 84 in a central wall 86 of the housing 56. It is preferred that, although the exterior of the lobe 82 does not touch the interior of the opening 84, that there be a close fit so that the lobe 82 (hence the shaft 52) does not have much sideways play in the opening 84.

The tremolo device 40 has a compression spring 90 disposed between and in contact with retainers 60, 62 which holds them apart as shown in FIG. 6. A spring 92 disposed between and in contact with retainers 64, 66 holds them apart as shown in FIG. 6. Depression of the arm 48 toward the body 42 reduces string tension and moves the shaft 52 to the right in FIG. 6 and the spring 90 is compressed between retainers 60, 62 since the nut 78 is secured to the shaft 52. The spring 92 remains at rest between retainers 64, 66 since retainer 64 abuts an end of the lobe 82 and retainer 66 abuts the nut 80. Then, upon release of the arm 48, permitting it to rise with respect to the body 42, the spring 90 pushes against its adjacent retainers thereby returning the arm 48 and therefore the strings 46 to substantially the same position and tension they were in before the arm was depressed.

Initially raising the arm 48 increases string tension and moves the shaft 52 to the left in FIG. 6. This compresses the spring 92 between the retainers 64, 66. The spring 90 is maintained in position between the retainers 60, 62 by the nut 78 and an end of the lobe 82. Upon release of the arm 48, allowing it to move downward toward the body 42, the spring 92 expands pushing outwardly on the retainers 64, 66 until the spring achieves its original un-compressed position thereby returning the strings to their original position and tension. It is preferred, although not required, that the spring 90's compressive force equal about 110% of the tension force on the strings. It is also preferred that the length of lobe 82 equal the length of opening 84. It is preferred that the compressive force of the spring 92 be equal to about 10% of the tension force of the strings.

In each of the tremolos 22 and 40, a conventional string retainer swivel 96 is employed which is connected to the movable tremolo shaft (13 or 52) by a pivotably connected member 94. The tremolo arm (11 or 48) is secured to the string retainer swivel 96 as are the strings (21 or 46).

Often in a multi-stringed instrument a string will break while the instrument is being played or when a tremolo device on the instrument is used. With prior art tremolo devices, the breaking of one string affects the tuning of the other strings. With my new instruments and new tremolo apparatuses the breaking of one string will not substantially affect the tuning of other strings.

Thus, it is seen that the apparatuses and methods of the present invention readily achieve the ends and advantages mentioned as well as other inherent therein. While certain preferred embodiments of the present invention have been described and illustrated for the purposes of disclosure, it will be clear to one of skill in this art who has the benefits of this invention's teachings that changes in the arrangement and construction of parts and steps may be made which changes are embodied within the spirit and scope of the present invention as claimed below. It is intended that each element or step recited in any of the following claims and each combination of elements is to be understood as referring to all equivalent elements or equivalent combinations for accomplishing substantially the same results in substantially the same or equivalent manner.

What is claimed is:

1. A tremolo apparatus for a musical instrument having a body and a plurality of one or more strings which are held in tension adjacent a sounding member of the instrument, the strings connected to the tremolo apparatus, the tremolo apparatus comprising a housing having a hollow interior, a string retainer swivel mounted to the sounding member of the instrument, a shaft movably mounted in a first portion of the hollow interior of the housing, a tremolo arm pivotably connected to the string retainer swivel and extending for access by a musician playing the musical instrument, a movable connecting member disposed between the shaft and the string retainer swivel and connecting them so that movement of the tremolo arm moves the shaft thereby changing the tension on the strings of the instrument, spring retaining means disposed on the shaft for retaining a spring, the spring retaining means including a first abutment retainer movably disposed on the shaft the spring yieldably urging the first abutment retainer against a shoulder of the housing, a lobe member connected to the shaft and extending into a second portion of the hollow interior of the housing which is in communication with its first portion, the lobe member in a rest position abuting the first abutment retainer so that after movement of the tremolo arm which produces a change in tension of the strings and results in movement of the lobe member in the second portion of the hollow interior, the spring moves the lobe member back into abutting contact with the first abutment retainer thereby returning the strings to a tension substantially the same as the strings' tension prior to movement of the tremolo arm.

2. The tremolo apparatus of claim 1 wherein the instrument is a guitar and the sounding member is a guitar sound box.

3. The tremolo apparatus of claim 1 wherein the spring retaining means includes a second abutment retainer movably disposed on the shaft and a locking nut holding the second abutment retainer in place, the spring disposed between and yieldably contacting the first and second abutment retainers.

4. A tremolo apparatus for a guitar having a guitar sound box and a neck extending therefrom with a plurality of one or more strings which are held in tension adjacent the sound box and are stretched above the neck and secured to one end of the neck, the strings connected to the tremolo apparatus, the tremolo apparatus comprising a housing having a hollow interior, a string retainer swivel mounted to the sound box of the guitar, a shaft movably mounted in a first portion of the hollow interior of the housing, a tremolo arm pivotably connected to the string retainer swivel and extending for access by a musician playing the guitar, a movable connecting member disposed between the shaft and the string retainer swivel and connecting them so that movement of the tremolo arm moves the shaft thereby changing the tension on the strings of the guitar, spring retaining means disposed on the shaft for retaining a spring, the spring retaining means including a first abutment retainer movably disposed on the shaft, the spring yieldably urging the first abutment retainer against a shoulder of the housing, the spring retaining means including a second abutment retainer movably disposed on the shaft and a locking nut holding the second abutment retainer in place, the spring disposed between and yieldably contacting the first and second abutment retainers, a lobe member connected to the shaft and extending into a second portion of the hollow interior of the housing which is in communication with its first portion, the lobe member in a rest position abuting the first abutment retainer so that after movement of the tremolo arm which produces a change in tension of the strings and results in movement of the lobe member in the second portion of the hollow interior, the spring moves the lobe member back into abutting contact with the first abutment retainer thereby returning the strings to a tension substantially the same as the strings' tension prior to movement of the tremolo arm.

5. A guitar comprising a sound box, a neck connected to and extending from the sound box, a plurality of strings connected in tension between an end of the neck and the sound box, a tremolo apparatus comprising a housing having a hollow interior, a string retainer swivel mounted to the sounding member of the instrument, a shaft movably mounted in a first portion of the hollow interior of the housing, a tremolo arm pivotably connected to the string retainer swivel and extending for access by a musician playing the musical instrument, a movably connection member disposed between the shaft and the string retainer swivel and connecting them so that movement of the tremolo arm moves the shaft thereby changing the tension on the strings of the instrument, spring retaining means disposed on the shaft for retaining a spring, the spring retaining means including a first abutment retainer movably disposed on the shaft, the spring yieldable urging the first abutment retainer against a shoulder of the housing, a lobe member connected to the shaft and extending into a second portion of the hollow interior of the housing which is in communication with its first portion, the lobe member in a rest position abutting the first abutment retainer so that after movement of the tremolo arm which produces a change in tension of the strings and results in movement of the lobe member in the second portion of the hollow interior, the spring moves the lobe member back into abutting contact with the first abutment retainer thereby returning the strings to a tension substantially the same as the strings' tension prior to movement of the tremolo arm.

6. A tremolo apparatus for a musical instrument having a body and a plurality of one or more strings which are held in tension adjacent a sounding member of the instrument, the strings connected to the tremolo apparatus, the tremolo apparatus comprising a housing having a hollow interior, the housing comprising a first hollow chamber and a second hollow chamber and a hollow middle opening between the two chambers and in communication with each of them, the hollow middle opening disposed between middle shoulders of the housing, which present a first side in the first hollow chamber and a second side in the second hollow chamber, a string retainer swivel mounted to the body of the instrument, a shaft movably mounted in and through the chambers and middle opening of the housing, the shaft extending outside of the housing through holes in the two chambers, a tremolo arm pivotably connected to the string retainer swivel and extending for access by a musician playing the musical instrument, a movably connecting member disposed between the shaft and the string retainer swivel and connecting them so that movement of the tremolo arm moves the shaft thereby changing the tension on the strings of the instrument, a first spring retaining means disposed on the shaft in the first hollow chamber for retaining a first spring, the first spring retaining means including a first abutment retainer movably disposed on the shaft, the first spring yieldably urging the first abutment retainer toward the first side of the middle shoulders of the first chamber of the housing, a second spring retaining means disposed on the shaft in the second hollow chamber for retaining a second spring, the second spring retaining means including a second abutment retainer movably disposed on the shaft, the second spring yieldably urging the second abutment retainer toward the second side of the middle shoulders of the housing, a lobe member connected to the shaft and disposed in the hollow middle opening of the housing so that neither the first nor the second abutment retainer can move past the lobe member upon movement of the shaft, the first and second springs disposed to urge the first and second abutment retainers respectively back to an original position after the tremolo arm has moved changing the tension of the strings, thereby returning the strings to a tension substantially the same as the strings' tension prior to movement of the tremolo arm.

* * * * *